United States Patent [19]

Adams

[11] Patent Number: 4,546,765

[45] Date of Patent: Oct. 15, 1985

[54] REDUCING MACHINE APPARATUS

[76] Inventor: Albert E. Adams, 224 Zion Way, Santa Ana, Calif. 92703

[21] Appl. No.: 566,389

[22] Filed: Dec. 28, 1983

[51] Int. Cl.[4] ..... A61H 23/00

[52] U.S. Cl. ..... 128/55; 128/56

[58] Field of Search ..... 128/54–59, 128/60–61, 44–53, 67

[56] References Cited

U.S. PATENT DOCUMENTS

| | | | |
|---|---|---|---|
| 1,625,977 | 4/1916 | Bevier | 128/54 |
| 2,294,947 | 9/1942 | Andis | 128/57 |
| 3,878,837 | 4/1975 | Werding | 128/57 |
| 4,046,142 | 9/1977 | Whitney | 128/55 |
| 4,162,675 | 7/1979 | Kawada | 128/55 |

*Primary Examiner*—Richard J. Apley
*Assistant Examiner*—David J. Brown
*Attorney, Agent, or Firm*—G. Donald Weber, Jr.

[57] ABSTRACT

There is shown and described an apparatus which can be used to reduce the fat content of parts of the human body.

8 Claims, 2 Drawing Figures

REDUCING MACHINE APPARATUS

BACKGROUND

1. Field of the Invention

This invention is directed to manually operated hygienic devices, in general, and to a hand-held machine which is used to reduce body fat, in particular.

2. Prior Art

It is a well-known fact, especially in the current day and age, that many people are desirous of removing body fat from their bodies. Moreover, many people cannot stand the regimen of dieting and/or extensive exercising. Consequently, many people are seeking other types of apparatus and/or devices for removing this undesirable body fat.

In the past, systems have been proposed which include various devices such as the vibrating massage belt, various hand-held massagers, rolling machines and the like. However, most of these devices have been known to be ineffective for one or more reasons. Usually, the problem is that the fat reducing device has been applied to a large area of the body rather than to a particular location thereof. Consequently, many of these devices have been virtually useless and ineffectual.

SUMMARY OF THE INVENTION

This invention is directed to a hand-held apparatus wherein ready application to a specific portion of the body is easily achieved. The apparatus includes a driving apparatus or mechanism together with a "beater" mechanism which is selectively placed against the particular area of the body which is under treatment. The driving apparatus or motor is of a usual design although operating parameters thereof may be important. The beater apparatus is formed basically of a cylindrical or annular device with a plurality of elements affixed thereto for striking the body portion in treatment when the cylinder is driven by the motor.

DESCRIPTION OF THE PREFERRED EMBODIMENT

Figure 1:
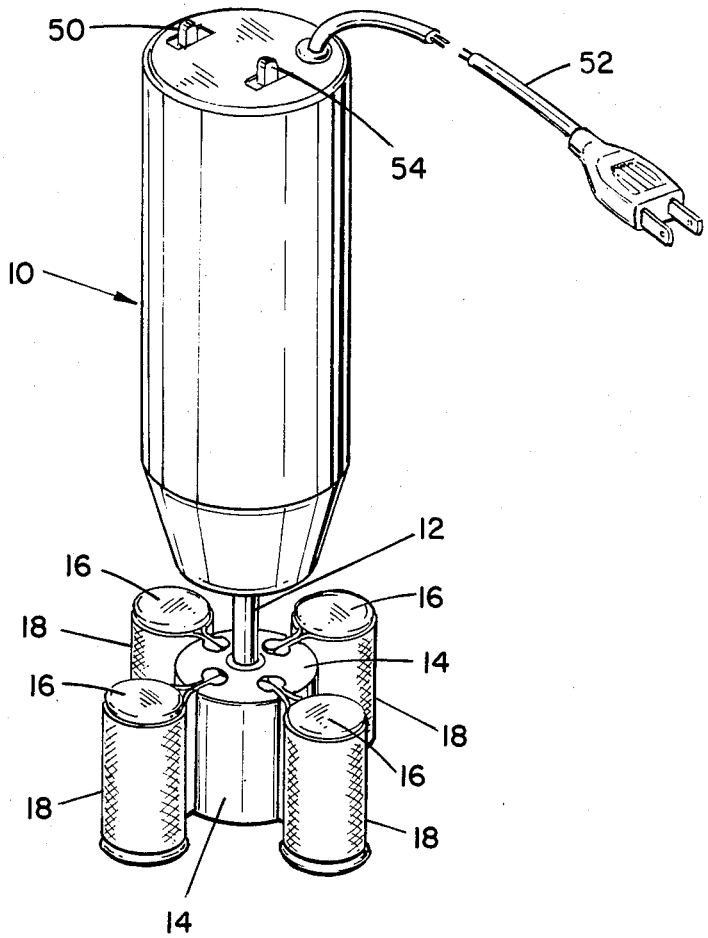
FIG. 1 is a generalized view of the entire apparatus.

Referring now to FIG. 1, there is shown the overall view of the apparatus of the instant invention. In particular, a motor 10 which is readily available in the art is provided. In a particularly effective embodiment, the motor is a 1/6 HP motor and is typically of fixed speed of approximately 700 RPM. The motor 10 is connected to a suitable power source. The motor may be battery operated or, it may be connected by an electric cord 52 to any suitable power supply. The switch 50 is provided to turn the motor on and off. A switch 54 is provided for direction reversal if desired.

The motor 10 includes a shaft 12 which extends therefrom. Shaft 12 is fixedly adjoined to cylinder 14 which may have an annular configuration. In a typical and useful embodiment, cylinder 14 has a diameter of approximately 2 inches and a length of about 2½ inches. The length and diameter of the cylinder 14 can be varied if so desired. However, it has been found that variations in the size of the cylinder will impact the operation of the device as a function of the motor speed and other parameters of the apparatus.

Figure 2:
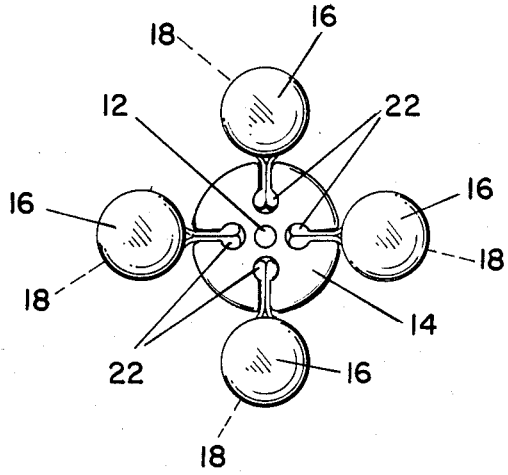
FIG. 2 is a detailed drawing of the relationship between the cylinder and the elements of the beater apparatus.

Referring now to FIGS. 1 and 2 concurrently, the beater portion of the apparatus is more clearly shown. That is, the cylindrical member 14 is defined to have a generally circular cross-sectional configuration. A plurality of cavities 20 are included therein. These cavities include a somewhat enlarged inner chamber which communicates through a bore or slot 24 with the outer surface of cylinder 14.

Each of the elements 18 includes a sheet of material such as neoprene rubber of the like. In a preferred embodiment, the rubber elements 18 are of the general consistency, strength and of the like the material used in an inner tube of the type used with automobile tires. The sheet 18 is a relatively thin member which is folded back on itself and has the ends thereof inserted into the slot 24 in cylinder 14. After the sheet 18 is inserted, it is preferable to insert a cylinder 16 of a suitable, relatively soft, sponge-like material such as foam rubber or the like into the loop formed by the folded sheet 18. Typically, the foam material is relatively heavy construction. Also, the ends of the foam cylinder 16 extend beyond the edges of sheet 18. Thus, the foam rubber is securely fastened within the sheet 18 which is secured in the slot and key way 24 in cylinder 14. That is, the ends of foam cylinder 16 tend to expand over the edges of the loop in sheet 18. Also, sheet 18 can include knobs 22 at the ends thereof to engage the slot 22 in cavity 20. Alternatively, keys or wedges can be used.

The type of material, e.g. rubber or the like, for sheet 18 is not a specific limitation on the invention. However, the material of sheet 18 is, preferably, reasonably flexible to permit the forming thereof as well as to permit the retention of foam rubber cylinder 16 and, as well, to permit the elements 18 to flex and move when the apparatus is utilized.

In similar fashion, the type of material which is used to form cylinder 16 is preferably of a foam-type material. However, it has been noted that a medium soft foam should be used to provide a greater efficiency in the use of the machine. That is, a relatively higher revolution rate of the motor is permitted while the patient is not irritated.

While the drawings show four of the rubber cylinder members, any other number may be used. However, it must be noted that in the experiments involved in producing this apparatus, the number of four cylinders was found to be most effective and efficient without causing skin irritation. Also, the cylinder members should, preferably be able to "lie down" on the periphery of cylinder 14 without touching the adjacent sheet 18. Also, the sheet 18 will preferably have sufficient resilience that the sheet 18 and cylinder 16 will attempt to stand outward from the cylinder 14. Thus, the sheet 18/cylinder 16 tends to "flap" at the surface of cylinder 14 when the apparatus is in use.

In using the apparatus, the device is turned on and the beater portion is placed substantially parallel to the skin of the patient. The beater is then brought into contact with the skin and produces a massaging operation relative to the body. This massage tends to break down the fatty tissue in the body and permits this to be absorbed in the rest of the body and disseminated.

Thus, there is shown and described a unique apparatus and method of using same in order to reduce and remove fatty tissue from the body. The apparatus, as shown, includes a preferred embodiment and description thereof. However, it must be understood that modifications to this preferred embodiment description can be made without departing from the inventive concepts. Rather, the description is intended to be illustrative only and is not intended to be limitative. The scope of the application is limited by the claims appended hereto.

Having thus described a preferred embodiment, what is claimed is:

1. A fatty tissue reducing machine comprising:

a driving apparatus, a rigid cylinder attached to said driving apparatus, said rigid cylinder including a plurality of axial slots disposed therein from the periphery of said rigid cylinder toward the center thereof, and flexible cylindrical members attached to said rigid cylinder, said flexible cylindrical members include a sheet of elastic material folded on itself and attached to said rigid cylinder by engaging said axial slots.

2. The machine recited in claim 1 wherein, said driving apparatus comprises a motor.

3. The machine recited in claim 2 wherein, said motor is an electric motor.

4. The machine recited in claim 3 wherein, said electric motor is a fixed speed motor.

5. The machine recited in claim 1 wherein, said rigid cylinder is attached to shaft of said driving apparatus and rotatably driven thereby.

6. The machine recited in claim 1 wherein, said slots terminate in enlarged cavities within the body of said rigid cylinder for receiving a portion of said sheet of elastic material,

7. The machine recited in claim 1 wherein, said flexible cylindrical members include a foam material disposed within said folded sheet of elastic material.

8. The machine recited in claim 1 wherein, said sheet of elastic material includes enlarged end portions which engage said axial slots.

* * * * *